United States Patent [19]

Appleby et al.

[11] Patent Number: 4,651,475

[45] Date of Patent: Mar. 24, 1987

[54] HONING TOOL

[76] Inventors: J. Robert Appleby, 640 Norton St.; Dennis H. Renwick, 849 S. Kerby, both of Corunna, Mich. 48817

[21] Appl. No.: 808,410

[22] Filed: Dec. 12, 1985

[51] Int. Cl.[4] ..... B24B 9/02

[52] U.S. Cl. ..... 51/338; 51/331; 51/204

[58] Field of Search ..... 51/331, 338–344, 51/346, 355, 204, 211 R

[56] References Cited

U.S. PATENT DOCUMENTS

| | | | |
|---|---|---|---|
| 18,392 | 10/1857 | Deming | 51/211 R |
| 1,846,371 | 2/1932 | Sunnen . | |
| 1,982,836 | 12/1934 | Sunnen . | |
| 2,009,222 | 7/1935 | Connor | 51/204 |
| 2,263,781 | 11/1941 | Kline . | |
| 2,265,377 | 12/1941 | Kline . | |
| 2,334,838 | 11/1943 | Prange . | |
| 2,421,470 | 6/1947 | Sunnen . | |
| 2,467,094 | 4/1949 | Peden . | |
| 2,713,758 | 7/1955 | Norkus | 51/204 |
| 2,749,682 | 6/1956 | Patrito | 51/204 |
| 2,790,277 | 4/1957 | Calvert | 51/346 |
| 2,823,498 | 2/1958 | Saunders . | |
| 2,903,828 | 9/1959 | Eldred | 51/204 |
| 3,016,660 | 1/1962 | Gross . | |
| 3,154,893 | 11/1964 | Greenberg et al. . | |
| 3,216,155 | 11/1965 | Sunnen . | |
| 3,403,481 | 10/1968 | McDonald . | |
| 3,645,050 | 2/1972 | Croll et al. . | |
| 3,678,630 | 7/1972 | Borcherding . | |
| 3,861,091 | 1/1975 | McDonald . | |
| 3,871,140 | 3/1975 | Kramm et al. . | |

FOREIGN PATENT DOCUMENTS

| | | | |
|---|---|---|---|
| 2128511 | 5/1984 | United Kingdom | 51/338 |

*Primary Examiner*—Harold D. Whitehead

*Attorney, Agent, or Firm*—Flynn, Thiel, Boutell & Tanis

[57] ABSTRACT

A honing device which employs a plurality of radially-displaceable tools mounted circumferentially around a rotary body. The tools are constructed as a laminate formed by the axially elongated abrasive strip bonded to and overlying a wood backing strip. The abrasive strip has a width, as measured in the direction of rotation, which is normally less than the width of the backing strip. The abrasive and backing strips are radially urged for simultaneous contact with the cylinder wall being honed.

19 Claims, 4 Drawing Figures

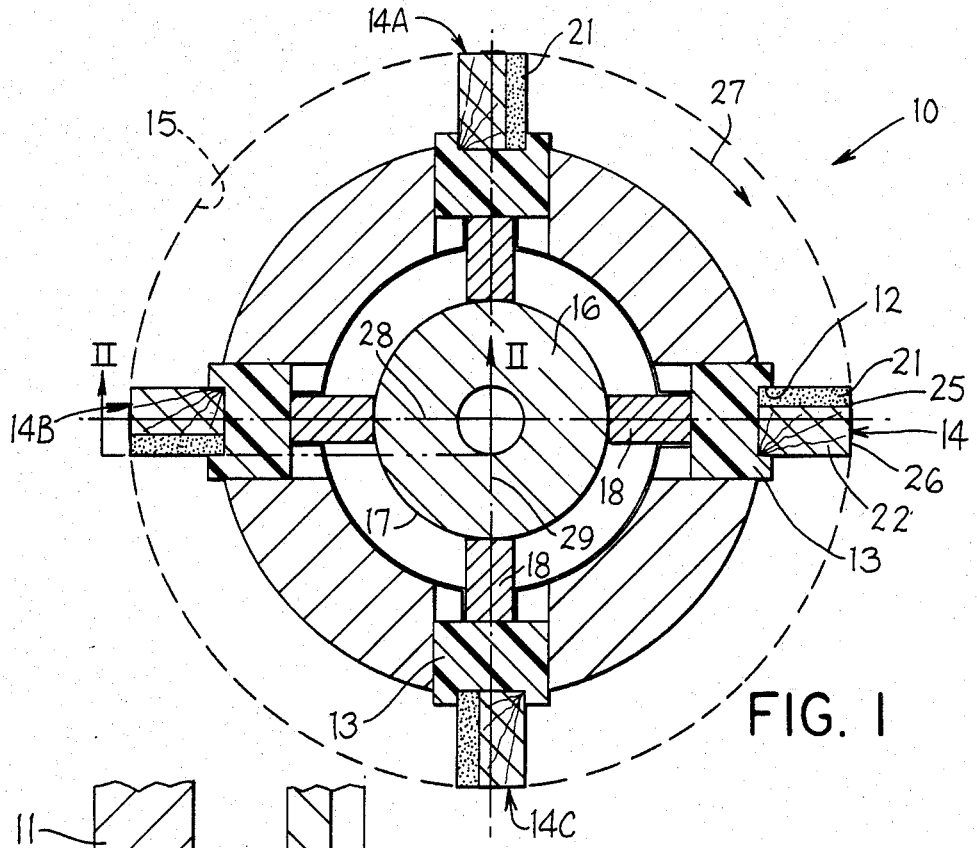
FIG. 1
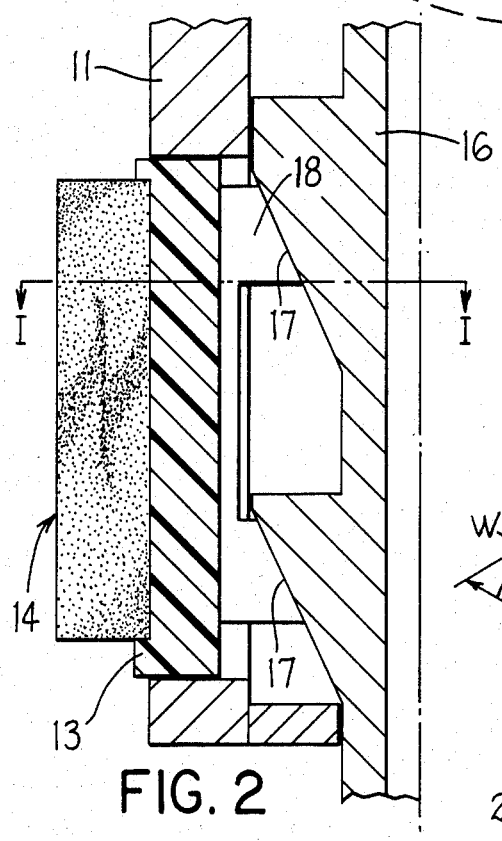
FIG. 2
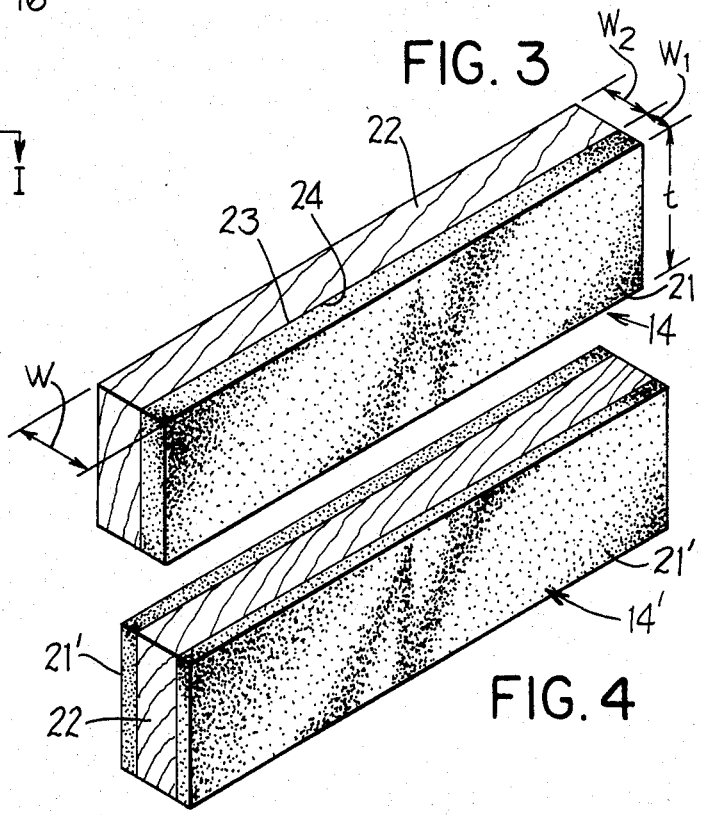
FIG. 3
FIG. 4

HONING TOOL

FIELD OF THE INVENTION

This invention relates to an improved honing device for honing an interior cylindrical wall and, in particular, to an improved abrasive honing element for use in conjunction with a honing device.

BACKGROUND OF THE INVENTION

Honing devices have long been and are still extensively utilized for finishing interior cylindrical walls, such as cylinder walls of internal combustion engines. Such devices typically employ a rotary body having several circumferentially-spaced slots formed radially thereof, which slots mount therein axially elongated abrasive honing elements. These honing elements are typically expanded radially outwardly of the body for contact with the cylinder wall by an actuator which, while it may assume many conventional forms, typically comprises a cone movable axially of the rotary body. Honing devices of this type are well known, and reference is made to U.S. Pat, Nos. 1,846,371, 1,982,836, 2,263,781, 3,154,893, 3,216,155, 3,645,050 and 3,861,091 which illustrate various such devices.

The conventional honing device has, for many years, employed a plurality of abrasive tools and wood guides disposed in circumferentially spaced relationship around the body so that both the tools and guides rubbingly engage the cylindrical wall. The device typically employs at least a pair of abrasive tools and a pair of guides, the tools and guides being conventionally positioned diametrically opposite one another and circumferentially alternately spaced so that the tools are hence disposed at substantially 180° intervals, the guides are similarly disposed at substantially 180° intervals, and the guides and tools are spaced approximately at 90° intervals. Arrangements of this general type are illustrated by U.S. Pat. Nos. 1,846,371, 1,982,836, 2,263,781 and 3,645,050. With arrangements of this latter type, it has been observed that use of at least one pair of guides is necessary, particularly when using only a pair of abrasive tools, to minimize vibration, noise and chatter.

In an attempt to increase the honing rate, others have attempted to eliminate the guides and increase the number of circumferentially-spaced abrasive tools. In some instance the number of tools has been dramatically increased. Examples of such structures are illustrated by U.S. Pat. Nos. 3,154,893 and 3,861,091. With such arrangements, however, it has been discovered that the increased contact area between the abrasive tools and the cylinder wall appears to increase the harmonic vibrations created during the honing operation, whereby noise and chatter increases and the quality of finish decreases, and hence such devices have normally proved less than desirable.

In an attempt to improve upon the noise and chatter characteristics associated with the typical honing device employing a diametrically opposed pair of stones (i.e. tools) and an intermediate diametrically opposed pair of guides, there has also been developed a honing device wherein the stones and guides are nonsymmetrically positioned. In this known device, as illustrated by U.S. Pat. No. 3,216,155, both the stones and guides are nonsymmetrically related, and in fact the stones are both disposed within one diametric half of the body, and both guides are disposed in the opposite diametrical half of the body. This arrangement, however, still employs large abrasive stones and separate guides for rubbing contact with the cylindrical wall and hence does not optimize finishing of the wall.

In the conventional honing devices, it has been a standard practice to utilize abrasive stones having a width (as measured in the direction of rotation) which is typically a minimum of about ⅜ inch to ½ inch. It has generally been believed that stones of substantial widths are required to permit effective finishing (i.e., honing) of the cylindrical wall. Further, these widths have been utilized so as to avoid cracking of the axially-elongated abrasive strips which define the stones. Such stones, however, are believed by Applicants to have been detrimental to the honing process in that they have increased the contact area, causing a corresponding increase in noise and chatter, and generation of substantial heat. Such stones have also generally resulted in increased use of greater contact pressure between the wall and stone so that the abrasive has been observed to crush and wear rapidly, and hence is unable to carry out an effective finishing operation.

In addition, conventional honing devices have typically required that the cylindrical wall be honed or finished using a two-step process. Initially, a rough finishing step is carried out utilizing abrasive elements of rather course grit, such as 150 to about 180 grit. Thereafter, the honing device must be removed from the cylinder and the course-grit abrasive elements removed and replaced with fine-grit elements, such as in the order of about 240 to 320 grit. The device is then reinserted into the cylinder and additional finishing carried out so as to provide the desired smooth finish on the cylindrical wall. Needless to say, this two-step process is undesirably labor intensive and time consuming, but nevertheless has been typically utilized in order to provide the cylinder wall with the desired finish.

Further, abrasive elements of fine grit are substantially more costly than abrasive elements of course grit, and hence users attempt to minimize the extent of use of fine grit stones due to the significant cost thereof.

Accordingly, it is an object of this invention to provide an improved abrasive honing element for use in conjunction with a honing device so as to overcome many of the disadvantages associated with prior art devices of this general type.

More specifically, it is an object of this invention to provide an improved honing tool for use on a honing device which employs a plurality of radially-displaceable tools mounted circumferentially around a rotary body, which tools are each preferably constructed as a laminate formed by the axially elongated abrasive strip bonded to a backing strip, the latter preferably being of wood. The abrasive strip has a width (as measured in the direction of rotation) which is relatively small and generally significantly less than the width of the backing strip, and both the abrasive and backing strips are radially urged for simultaneous contact with the cylinder wall which is being honed.

In a preferred embodiment, the honing device is normally provided with at least two pairs of said tools mounted circumferentially therearound, with the tools of each circumferentially-adjacent pair being reversely circumferentially oriented so that the abrasive strips on each adjacent pair of tools are reversely circumferentially oriented. The tools are preferably mounted such that the abrasive strips as located circumferentially around the body are disposed in a nonsymmetric or nonuniform arrangement, this preferably being achieved by mounting the plurality of tools uniformly angularly around the body so that the reverse circumferential orientation of the tools hence results in the abrasive strips being nonuniformly angularly spaced.

The improved tool of this invention, as utilized in a honing device, such as described above, preferably employs an abrasive strip having a width of about ⅛ inch, which width is significantly smaller than that typically utilized in the honing industry, and the backing strip of wood preferably has a width which is greater than the width of the abrasive strip. This hence provides proper strength and backing for the thin abrasive strip, and at the same time permits the abrasive strip to be radially urged against the cylinder wall with significantly high contact pressures if desired. At the same time, the tool of the present invention results in the face of the wood backing strip also being pressed against the cylinder wall simultaneous with the face of the abrasive strip so that both the abrasive and wood faces effectively perform a finishing operation.

Initial experimental evaluation indicates that this invention enables the use of lower contact pressure between the tool and the cylinder wall in conjunction with the use of a stone of large grit in the order of 150 to 180 grit size, while still enabling the honing operation to be carried out at a more rapid rate and providing a finish of high quality which is more comparable to a finish which could previously be achieved only by utilizing a stone of high grit such as in the order of at least about 240. It is believed that the improved tool of this invention is able to achieve this highly desirable result inasmuch as the contact of the wood face against the cylinder wall directly adjacent the abrasive face provides a much more uniform distribution of pressure throughout the contact area, and at the same time significantly minimizes vibration and chatter directly at the contact area. Further, this also provides better control over the wear and penetration of the abrasive face into the cylinder wall so that the larger grit can more effectively perform a cutting action so as to effect material removal. It is believed that this improved cutting action is due to the fact that the large grits remain bonded to the stone, rather than being broken from the stone as in conventional tools, whereupon the grit gradually wears down to a smaller size so as to create a finer finish on the cylinder wall. The wood face also appears to significantly assist the cutting action by effecting a smoother finishing or polishing so that the resultant cylindrical wall is hence of smooth finish, and in fact is of a much higher degree of smoothness than would otherwise be obtainable using an abrasive strip of such large grit. In fact, it has been observed that the desired quality finish can be achieved using the tool of this invention, employing a strip of large size grit, while performing only a one-step finishing operation, in contrast to the required two-step process required by prior art devices.

Hence, the improved tool and honing device of this invention is believed to represent a significant improvement in the honing art since it permits the use of a coarser grit for the complete finishing operation so as to provide economy of material, it permits the finishing to be carried out at a higher speed which is typically accomplished solely when using coarse grit but at the same time provides a finish which could previously be accomplished solely using fine grit, it permits the finishing to be accomplished using a lower contact pressure so as to minimize wear of the honing device, it provides greater life for the tools since the grit appears to permit the desired finishing to be accomplished by a true cutting action rather than a crushing of the grit, it permits the use of a stone requiring less quantity of expensive abrasive and bonding agent, and it permits the overall finishing operation to be accomplished in a significantly more efficient manner which is both less time consuming and less labor intensive since the finishing operation can be effectively accomplished in one-step rather than two-steps as normally previously required.

In a variation of the improved tool of this invention, an abrasive strip is bonded to both sides of the wood backing strip. The total width of the two abrasive strips is less than the width of the wood strip. This tool is preferred for use on honing devices using a large number of tools, such as power-driven devices employing six or more tools.

Other objects and purposes of the invention will be apparent to persons familiar with structures of this general type upon reading the following specification and inspecting the accompanying drawings.

BRIEF DESCRIPTION OF THE DRAWINGS

FIG. 1 is a sectional view which illustrates a honing device according to the present invention as taken substantially along line I—I in FIG. 2.

FIG. 2 is a fragmentary sectional view taken substantially along line II—II in FIG. 1.

FIG. 3 is a perspective view of the improved honing tool according to this invention.

FIG. 4 is a view like FIG. 3 but showing a variation of the tool.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the device and designated parts thereof. Said terminology will include the words specifically mentioned, derivatives thereof, and words of similar import.

DETAILED DESCRIPTION

Referring to the drawings, there is illustrated a honing device 10 according to the present invention. This device includes a body 11 which is typically constructed as a sleeve and is provided with structure defining recesses 12 therein, which recesses are spaced circumferentially around the body and open radially thereof. Each recess is provided with a holder or mounting structure 13 adapted for releasable engagement with an abrasive tool or element 14. The abrasive element 14 is designed for effecting finishing, i.e. honing, of an internal cylindrical work surface 15, such as the cylinder wall of an internal combustion engine.

The honing device includes an actuator 16 which may be of any conventional configuration, this actuator 16 being illustrated as a cone-type actuator having conical surfaces 17 thereon which react against individual actuator plates 18, the latter being disposed in engagement with the holders 13 so as to urge the abrasive tools radially outwardly in response to axial displacement of the actuator.

The structure of the body, actuator and holder is conventional, and in fact may assume many different conventional configurations, some of which are illustrated by the aforementioned patents. Hence, the structure which has been briefly illustrated and described above is solely to facilitate an overall understanding of the honing device and is not intended to be restrictive as to the basic structure of the device.

Considering now the improved structure associated with the improved tool or element 14, same includes an abrasive member or strip 21 and a backing member or strip 22 disposed so that the side surfaces 23 and 24 thereof overlap and in fact are fixedly joined together, as by a suitable adhesive such as a two-part epoxy, whereby the strips 21 and 22 are effectively rigidly bonded together and thus form a rigid laminated structure. The abrasive member 14 is, as is conventional in the honing art, constructed of an abrasive grit which, while it can be of any size, is preferably in the range of 150 to 180 grit size since it has been observed that this larger grit size provides economy of manufacture and quality of finish, while permitting the operation to be carried out at a highly desirable speed. The grit size can, however, be varied and selected in accordance with any specific use requirements.

As to the backing member 22, it is preferably constructed of a wood, such as oak. However, the hardness of the wood as well as the type of bonding material for the grit can be varied in accordance with the hardness of the metal being finished, and hence other woods such as pine or walnut can also be used in some circumstances.

The tool 14, when the strips 21 and 22 have been laminated together, defines thereon an edge surface or face 25 which extends along the abrasive strip and effectively functions as a cutting face. Similarly, the wood backing member 22 has an edge surface or face 26 which is substantially coplanar with the cutting face 25. This wood face 26 functions as a supporting and polishing face.

The abrasive strip 21, when used on a manual honing device for finishing bores in the range of three to five inch diameter, preferably has a width "$W_1$" (which width is measured in the circumferential direction of the honing device) of about ⅛ inch, this width "$W_1$" preferably being in the range of from about 3/32 to about 5/32 inch. The wood backing strip 22, on the other hand, preferably has a width "$W_2$" which is at least equal to and is preferably about twice the width "$W_1$". The tool 14 also preferably has a thickness "t" (as measured radially of the honing device) which is preferably a minimum of 3 to 4 times the width "$W_1$". The overall length of the tool 14, which length extends axially of the honing device, is obviously several times greater than the thickness "t", this length being selected in accordance with the requirements of the honing device and of the cylinder wall being finished.

The improved honing device 10 of the present invention is preferably provided with at least four tools 14 mounted thereon (these tools being designated 14, 14A, 14B and 14C in FIG. 1 for convenience in illustration), such tools being used for manual finishing of small bores (3 to 5 inch) of internal combustion engines. The tools are preferably disposed in circumferentially adjacent pairs, such as a pair of tools 14 and 14A in FIG. 1, with the tools of adjacent pairs being reversely circumferentially oriented. For example, assuming the honing device to be rotating in the direction of the arrow 27, which direction is clockwise in the illustrated embodiment, then the circumferentially adjacent pair of tools 14 and 14A are preferably disposed so that the abrasive strips 21 thereon are reversely circumferentially oriented. As illustrated, the abrasive strip 21 on the tool 14 faces in the counterclockwise direction and hence trails the respective wood strip 26, whereas the abrasive strip 21 of the tool 14A faces in the clockwise rotational direction and hence leads its respective wood strip. The other pair of tools 14B and 14C are similarly oriented.

Most conventional honing devices mount the tools on the body such that the tools are uniformly angularly spaced. As illustrated by FIG. 1, the body 11 has perpendicular axes 28 and 29 which intersect the recesses 12, which recesses mount therein the tools and the respective holders. Hence, the four tools illustrated in FIG. 1 are uniformly angularly spaced apart substantially at 90° intervals. However, by reversely orienting the adjacent pairs of tools as explained above, this hence results in the abrasive strips 21 of the adjacent tools 14 and 14A being spaced apart by an angle less than 90°, and similarly the abrasive strips associated with the tools 14B and 14C are also spaced apart by an angle less than 90°. This hence results in the angle between the abrasive strips associated with the tools 14 and 14C, and also between the tools 14A and 14B, being greater than 90°. The abrasive strips associated with the four tools are hence disposed in an nonuniform angularly spaced relationship, and this hence minimizes noise and chatter caused by harmonic vibration created during the honing operation.

Initial experimental evaluation of surfaces finished using the improved honing tool of this invention, particularly when oriented as illustrated by FIG. 1, has indicated that a high-quality finish can be obtained utilizing a single-step process, in contrast to the prior two-step processes typically utilized, and the one-step process of this invention can be accomplished in from one-third to one-fourth the time previously required. Hence, the present invention would appear to permit the finishing of cylinder walls to be accomplished at a rate three to four times greater than previously possible, which rate is due in part to the fact that the process can be accomplished in one-step rather than two. The increase in speed is also due to the fact that it has been observed that approximately only one half as many revolutions are required to provide the required finish on the surface when using the honing tool of the present invention. At the same time, further economies are achieved by the use of stones formed solely of larger grit, whereby the use of stones formed from expensive small grit material is hence avoided.

Referring now to FIG. 4, there is illustrated a variation of the improved honing tool of the present invention. The tool 14' as illustrated by FIG. 4 is substantially identical to the tool 14 of FIG. 3 except that it has abrasive strips 21' bonded to opposite sides of the wood strip 22. Each of the abrasive strips 21' preferably has a width which is one-half the width of the abrasive strip 21 of FIG. 3, whereby the total width of the two abrasive strips 21' thus equal the width $W_1$ of the abrasive strip 21. The tools 14 and 14' hence both have the same total width, and also have the same width of abrasive relative to wood.

The honing tool 14' is preferably utilized in honing devices which employ a large number of tools mounted thereon, such as the automated or power-driven honing devices which typically employ between 6 and 12 honing tools mounted circumferentially therearound.

While the tool 14' is illustrated as employing separate abrasive strips 21' adhesively bonded to opposite sides of the wood strip 22, it is also contemplated that the tool could be formed by initially providing a large rectangular block of abrasive having a width corresponding to the tool, which abrasive would have a rectangular slot machined longitudinally thereof so as to define the abrasive strips 21' on opposite sides of the slot, following which the wood strip 22 would then be bonded within the slot so that the tool would hence again define thereon a working face involving two narrow abrasive strips bonded to opposite sides of a wood strip substantially as illustrated by FIG. 4. Such would again constitute a laminated tool having the wood bonded to and between the abrasive strips.

While it is anticipated that the total width of the abrasive will normally be in the aforementioned range when the tool is used for finishing cylinder walls of internal combustion engines, nevertheless it is also contemplated that the improved tool of this invention will also be highly advantageous for use with other industrial applications, such as finishing the interior cylindrical wall of large diameter bores of the type utilized in fluid pressure cylinders and other industrial equipment. In such applications, particularly involving large diameters, the width of the tool and hence the width of the stone may have to be increased significantly somewhat in proportion to the bore diameter, and in fact it is contemplated that a tool having a stone face width of one-half inch and a wood face width of at least one-half inch may be used.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a honing device having a body, a plurality of tool assemblies moveably mounted on said body in angularly spaced relationship therearound, said tool assemblies projecting radially for engagement with an interior cylindrical wall to effect finishing thereof, each said tool assembly including a removable and replaceable tool, and an actuator means movably associated with said body and coacting with said tool assemblies for effecting movement of the latter radially outwardly for engagement with the cylindrical wall, the improvement wherein said removable tool comprises:

an abrasive member of a platelike configuration, said abrasive member being constructed of abrasive grit bonded together, a backing member of a platelike configuration, said backing member being constructed of wood, said abrasive and backing members being disposed with opposed side faces thereof in superimposed and overlapping relationship, said side faces being bonded together so that said abrasive and backing members are rigidly and permanently joined together to form a one-piece laminate, said one-piece laminate defining thereon a front face which faces radially outwardly for engagement with the surrounding cylindrical wall, said front face having first and second surface portions which are substantially continuous and disposed side by side in the circumferential direction of the surrounding cylindrical wall, the first surface portion being defined by the abrasive member and the second surface portion being defined by the backing member, said abrasive member and the first surface portion defined thereby having a width as measured in said circumferential direction which is no more than about one half the width of the laminate.

2. A device according to claim 1, wherein said abrasive member has a width in the range of from about 3/32 to about 5/32 inch.

3. A device according to claim 2, wherein the abrasive member has a thickness as measured radially of the device which is at least about three to four times greater than its width.

4. A device according to claim 3, wherein said abrasive member has a grit size in the range of from about 150 to 180.

5. A device according to claim 2, wherein said backing member has a width which is at least about twice the width of the abrasive member.

6. A device according to claim 1, wherein said backing member has a width which is at least about twice the width of the abrasive member.

7. A device according to claim 6, wherein said abrasive member is laminated to only one side face of said backing member so that the other side face of the backing member is free of abrasives.

8. A device according to claim 1, wherein said body mounts thereon four said tool assemblies at substantially uniformally angularly spaced intervals therearound, each of said tool assemblies including a said tool removably associated therewith, the tools as associated with two of the tool assemblies which are disposed in circumferentially adjacent relationship being reversely circumferentially oriented so that the abrasive members circumferentially face one another and are spaced apart by an angle of less than 90°, and the tools associated with the other two tool assemblies also being reversely circumferentially oriented so that the abrasive members face circumferentially in opposite directions.

9. A device according to claim 8, wherein the tool assemblies of said first pair are disposed for radial movement along lines which extend at an angle of 90° with respect to one another, and said other tool assemblies being spaced remote from the 90° angular spacing between the tool assemblies of said first pair.

10. A device according to claim 1, wherein a second abrasive member of a platelike configuration is disposed in superimposed and overlapping relationship to the other side face of said backing member and is bonded thereto, whereby said backing member is bonded between said first-mentioned and said second abrasive members so as to define said one-piece laminate, the front face of said laminate having a third surface portion thereon which is defined by said second abrasive member and is substantially continuous with said first and second surface portions.

11. A device according to claim 10, wherein the total width of said first-mentioned and second abrasive members as measured in the circumferential direction is no more than about one-half the overall width of the tool.

12. A honing device, comprising a rotary body adapted to the position within a bore defined by a surrounding cylindrical wall, a plurality of tool assemblies moveably mounted on said body in circumferentially spaced relationship therearound, each tool assembly being moveably supported relative to said body for movement radially thereof along a respective radial direction, said plurality of tool assemblies and the radial directions respectively associated therewith being uniformly angularly spaced apart, actuator means for effecting selected radially outward displacement of the tool assemblies for causing them to engage the surrounding cylindrical wall, each said tool assembly including an axially elongated and removable tool which projects radially outwardly and defines a radially outer face adapted for engagement with said cylindrical wall, said tool being of a one-piece laminated structure formed by overlying and coextensive abrasive and wood plates which are rigidly bonded together, said abrasive and wood plates being disposed so as to extend in the radial and axial directions so that the wood and abrasive plates are circumferentially disposed with one leading the other, said wood plate having a thickness in said circumferential direction which is at least about two times greater than the thickness of the abrasive plate as measured in said circumferential direction.

13. A device according to claim 12, wherein said abrasive plate has the thickness as measured in said circumferential direction which is in the order of about one-eighth inch.

14. A device according to claim 12, wherein said plurality of tool assemblies includes at least four said tool assemblies disposed uniformly angularly spaced apart.

15. A device according to claim 12, wherein each circumferentially-adjacent pair of said tools are disposed with the abrasive plates oriented circumferentially in opposite directions.

16. A device according to claim 15, wherein the angular spacings between the adjacent pairs of abrasive plates are nonuniform.

17. In a honing device having a body, and a tool assembly mounted on said body so as to project radially relative to the periphery thereof for engagement with an interior cylindrical wall to effect finishing thereof in response to rotation of the body relative to the cylindrical wall, said tool assembly including a removable and replaceable tool, the improvement wherein said removable tool comprises:

an abrasive member of a platelike configuration, said abrasive member being constructed of abrasive grit bonded together, a backing member of a platelike configuration, said backing member being constructed of wood, said abrasive and backing members being disposed with opposed side faces thereof in superimposed and overlapping relationship, said side faces being bonded together so that said abrasive and backing members are rigidly and permanently joined together to form a one-piece laminate, said one-piece laminate defining thereon a front face which faces radially outwardly for engagement with the surrounding cylindrical wall, said front face having first and second surface portions which are substantially continuous and disposed side-by-side in the circumferential direction of the surrounding cylindrical wall, the first surface portion being defined by the abrasive member and the second surface portion being defined by the backing member, said abrasive member and the first surface portion defined thereby having a width as measured in said circumferential direction which is no more than about one-half the width of the laminate, whereby both of said first and second surface portions contact the cylindrical wall to effect finishing thereof.

18. A device according to claim 17, wherein the backing member has a width which is at least about twice the width of the abrasive member.

19. A device according to claim 18, wherein said abrasive member has a width in the range of from about 3/32 to about 5/32 inch, and wherein the abrasive member has a thickness as measured radially of the device which is at least about 3 to 4 times greater than its width.

* * * * *